US007270355B2

(12) United States Patent
Powell

(10) Patent No.: US 7,270,355 B2
(45) Date of Patent: Sep. 18, 2007

(54) ELECTRICALLY CONTROLLED DOOR LOCK

(75) Inventor: Simon Powell, Herts (GB)

(73) Assignee: PBT (IP) Limited (GB)

( * ) Notice: Subject to any disclaimer, the term of this patent is extended or adjusted under 35 U.S.C. 154(b) by 59 days.

(21) Appl. No.: 10/511,257

(22) PCT Filed: Apr. 14, 2003

(86) PCT No.: PCT/GB03/01621

§ 371 (c)(1),
(2), (4) Date: Aug. 8, 2005

(87) PCT Pub. No.: WO03/087503

PCT Pub. Date: Oct. 23, 2003

(65) Prior Publication Data

US 2006/0006662 A1 Jan. 12, 2006

(30) Foreign Application Priority Data

Apr. 12, 2002 (GB) ..... 0208508.2

(51) Int. Cl.
*E05B 15/02* (2006.01)
*E05C 3/06* (2006.01)

(52) U.S. Cl. ..... 292/341.16; 292/340; 292/341.15; 292/341.17

(58) Field of Classification Search ..... 292/341.16, 292/340, 341, 341.15, 341.17, 251.5, 144, 292/201
See application file for complete search history.

(56) References Cited

U.S. PATENT DOCUMENTS 390,795 A * 10/1888 Neu ..... 292/341.16
1,880,850 A * 10/1932 Dautrick ..... 70/282
4,211,443 A * 7/1980 Butts et al. ..... 292/341.16
4,471,983 A * 9/1984 Bischoff et al. ..... 292/341.16
4,815,776 A * 3/1989 Fuss ..... 292/341.16
5,484,180 A * 1/1996 Helmar ..... 292/341.16
5,681,070 A * 10/1997 Williams et al. ..... 292/341.16
5,788,295 A * 8/1998 Fuss et al. ..... 292/341.16
5,924,750 A * 7/1999 Fuss et al. ..... 292/201
5,988,711 A * 11/1999 Toma ..... 292/341.16
6,634,685 B2 * 10/2003 Herron et al. ..... 292/341.16
6,935,663 B2 * 8/2005 Schildwachter et al. ..... 292/341.16
7,144,053 B2 * 12/2006 Bashford ..... 292/341.16

FOREIGN PATENT DOCUMENTS

| | | |
|---|---|---|
| DE | 1 138 334 | 10/1962 |
| EP | 0 757 145 | 2/1997 |
| EP | 0 851 077 | 7/1998 |
| FR | 2 726 847 | 5/1996 |

* cited by examiner

*Primary Examiner*—Carlos Lugo
(74) *Attorney, Agent, or Firm*—Renner, Kenner, Greive, Bobak, Taylor & Weber

(57) ABSTRACT

An electrically controlled door lock (11) provided with a blocking member (21) and a detent (20), the blocking member being in contract with an electrically controlled actuator (24) such as a piezo-electric member which is used to control movement of the blocking member which in turn causes either the release of a locking member (12) from a door to allow the door to be opened or the engagement of the locking member to prevent the door from being opened.

6 Claims, 3 Drawing Sheets

ELECTRICALLY CONTROLLED DOOR LOCK

The present invention relates to door locks and more particularly to a door lock which is electrically controlled.

It is known to provide door locks which are a combination of a conventional door lock which can be activated by a key but which can also be released by means of an electrical control signal so that the door can be pushed open without the use of a key. These are common in apartment blocks.

Customarily, the electrical control signal is used to move a member out of position to such an extent that the locking member attached to the door no longer prevents the door being pushed open.

Despite the fact that such locks have been available for a considerable number of years, there still exists the need to provide a reliable electrically actuated arrangement at low cost and particularly one which can be installed in either a normally closed or normally open condition.

The present invention provides an electrically activated door lock in which a piezo electric member is used to control movement of a blocking member which in turn controls the latching of the door.

Preferably, the blocking member and the retaining member are shaped so as to permit movement of the blocking member to either release the locking member to allow a door to be opened or engage the member so as to prevent the door being opened.

In order that the present invention be more readily understood, an embodiments thereof will now be described by way of example with reference to the accompanying drawings in which.

Figure 1:
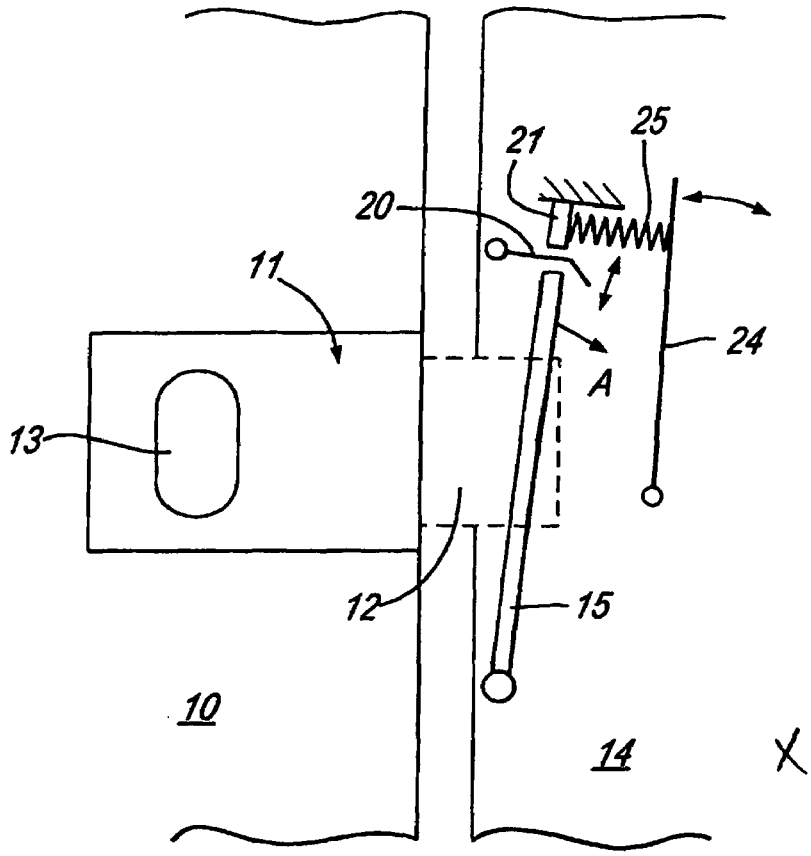
FIG. 1 shows a diagrammatic representation of an electrically activated latching mechanism according to a first embodiment of the present invention.

Referring now to FIG. 1, this shows a door 10 provided with a lock 11 having a retractable locking member 12 which is normally retracted by means of a manually engageable knob 13 or a key in the conventional manner. The latching member 12 is received in a recess in a door jamb 14 and in the normal condition is arranged to engage with a blocking member 15 which prevents the door being opened unless the latching member 12 is retracted.

In order to electrically control the lock, the blocking member 15 is pivotal in the direction of the arrow A if it is desired to permit someone without a key opening the door. The pivotal movement is sufficient to allow the latching member 12 to clear the member 15 on simply pushing the door.

Movement of the member 15 in the direction of the arrow A is controlled by a pawl 20 which engages the end of the member 15 but is capable of being moved out of the way of the end of the member 15 so as to permit the member 15 to rotate in the direction of the arrow A.

Movement of the pawl 20 is in turn electrically controlled by means of a index member 21. In one position of the index member 21 rotational movement of the pawl 20 is inhibited due to engagement with the member 21. This in turn inhibits rotational movement of the member 15 in the direction of the arrow A when the door is pushed. However, if an electrical signal is supplied to a suitable actuator, the index member 21 is moved to a second position where, if the door is pushed, the member 15 attempts to move in the direction of the arrow A. This causes the pawl 20 to attempt to move arcuately upwards which it can now do due to the fact that the blocking member has moved to its second position. In this way, the door can simply be pushed open.

Electrical control of the member 21 is achieved by means of a piezo-electric actuator which, when pulsed, will cause the blocking member to move from the first to the second position. To ensure that mechanical forces derived from the locking member are not transferred to the piezo-electric actuator 24, the member 21 is resiliently coupled to the actuator 24 and in this case this is achieved by means of a spring 25.

Figure 2:
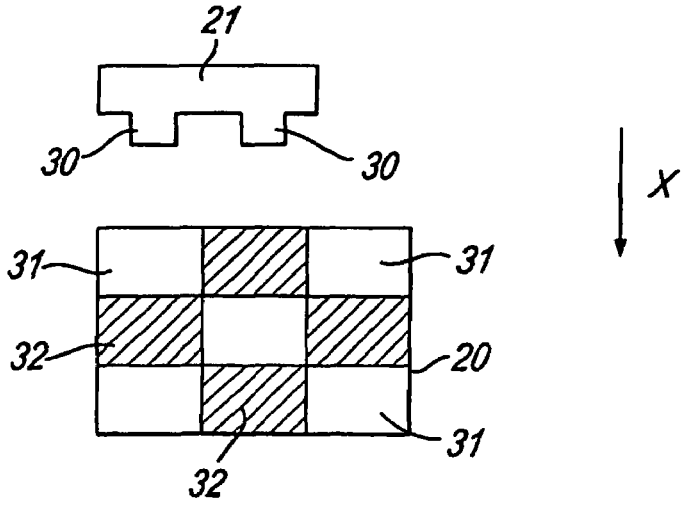
FIG. 2 shows diagrammatically a reversing mechanism capable of altering the operation of the mechanism shown in FIG. 1 from a normally open condition to a normally closed condition.

A particular feature of the preferred embodiment is that the contact surfaces of the member 21 and the pawl 20 are shaped so that simply by presetting the orientation of the member 21 and pawl 20 the lock can operate so that the door can either be in a normally open or a normally closed condition and the application of the electrical control signal locks or opens the door as desired. In this embodiment this is achieved by the member 21 being provided with two projecting teeth 30 as shown in FIG. 2 which are spaced apart. The contact surface of the pawl 20 is provided with mating projections and recesses with the recesses 31 being located at the same pitch as the projections 30 on the blocking member 21 and consequently spaced apart by the same amount. By arranging that on initial installation the members 21 and 20 are arranged so that the projections 30 on the member 21 are normally arranged to be received in recesses 31 in the initial unenergised condition of the piezo-electric member 24, the door will be a normally open door which when the blocking member is moved in the direction of the arrow X in FIG. 2 results in the projections 30 meeting the projections 32 on the detent 20 in the event that the door is pushed which prevents the detent from rotating and consequently the door from being opened. It will be appreciated that by initially setting the reverse conditions the door will be normally closed but will be capable of being pushed open when the blocking member is moved under the control of the piezo-electric actuator so that the projections 30 mate with the recesses 31.

The manner in which the operation of the lock can be preset in either of the embodiments is a matter of design choice but could be achieved simply by providing the pivot of the pawl 20 in the form of a bar along which the detent 20 is slid. Likewise, the member 21 could be moved if it were located in a slide way.

Figure 3:
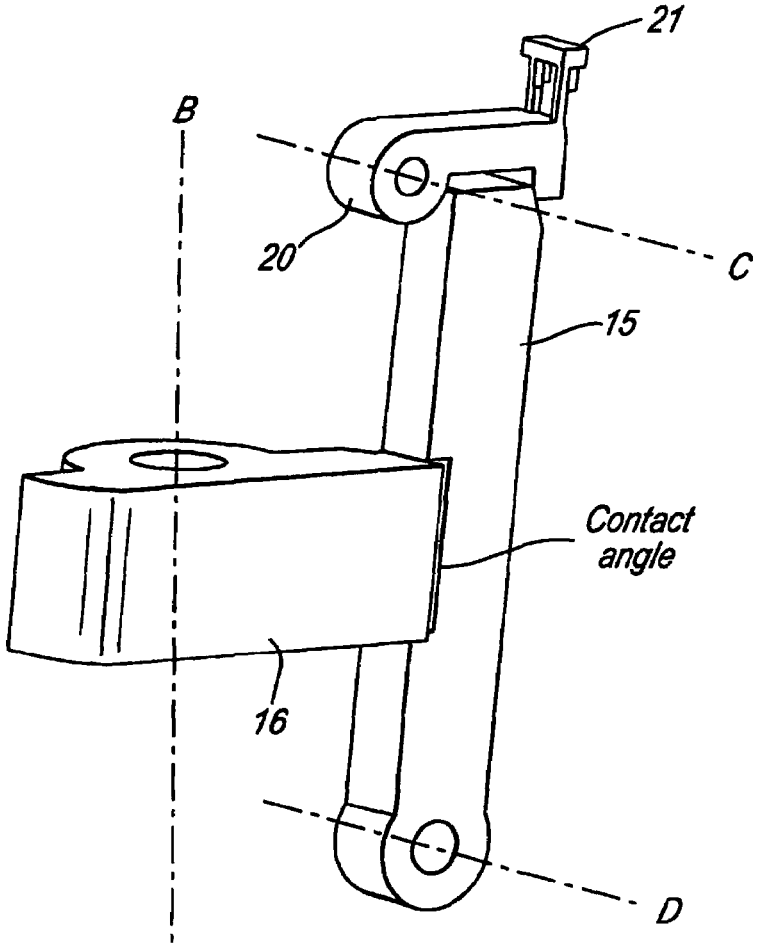
FIG. 3 shows a section of the electrically actuated latching mechanism according to a second embodiment of the present invention.

FIG. 3 shows a second embodiment of the electrically activated latching mechanism according to the present invention. The same reference numerals are used as the first embodiment for the same features.

The mechanism is similar to the first embodiment and includes a strike plate member 16. The strike plate 16 is positioned such that movement of the strike plate causes the movement of the member 15.

In use, a locking member (not shown) in a door pushes against the strike member 16 which causes a torque movement with rotation about axis B. This torque is transmitted to the member 15 via suitably angled surfaces to provide a first stage of force reduction. The resultant torque created on the member 15 is transferred to the pawl 20 which is rotatably connected to the casing which is not shown in FIG. 3. The pawl 20 and member 15 move about axis C and axis D respectively with the two axis being parallel to each other.

The index member 21, as in the first embodiment, moves radially with respect to the pawl 20 and is electrically controlled by means of a piezo-electric actuator.

There are protrusions on the member 21, that correspond to protrusions on the pawl 20 such that when the two sets are aligned as in FIG. 3, the index member 21 is pushed against an immovable surface that forms part of the casing, not shown. The compressive stress prevents rotation of the pawl 20 and hence the strike 16 is unable to rotate and the mechanism is locked.

Movement of the member 21 causes the protrusions to become misaligned and the pawl 20 is free to rotate and the lock is open.

Figure 4:
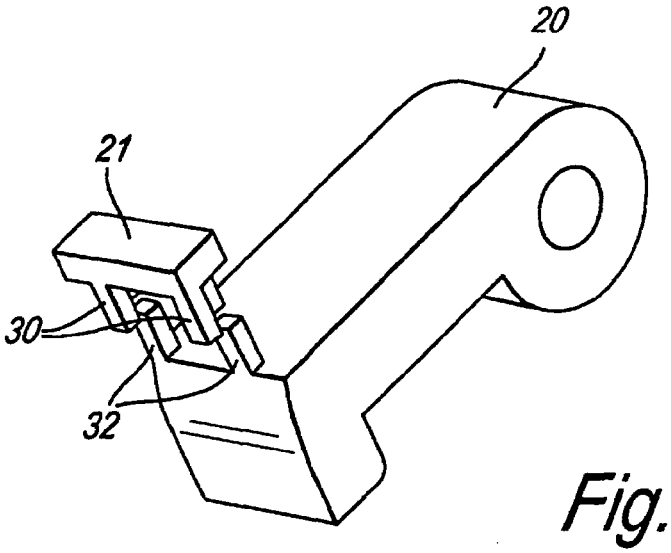
FIG. 4 shows the mechanism shown in FIG. 3 initially set in a reverse condition.

Additionally, the mechanism in the second embodiment may be initially set in reverse conditions to alter the mechanism from a normally locked condition to a normally unlocked condition. This may be achieved by initially misaligning the set of protrusions 30 on the member 21 and protrusions 32 on pawl 20 as shown in FIG. 4 such that the lock is open when without power and locks when power is applied.

Figure 5:
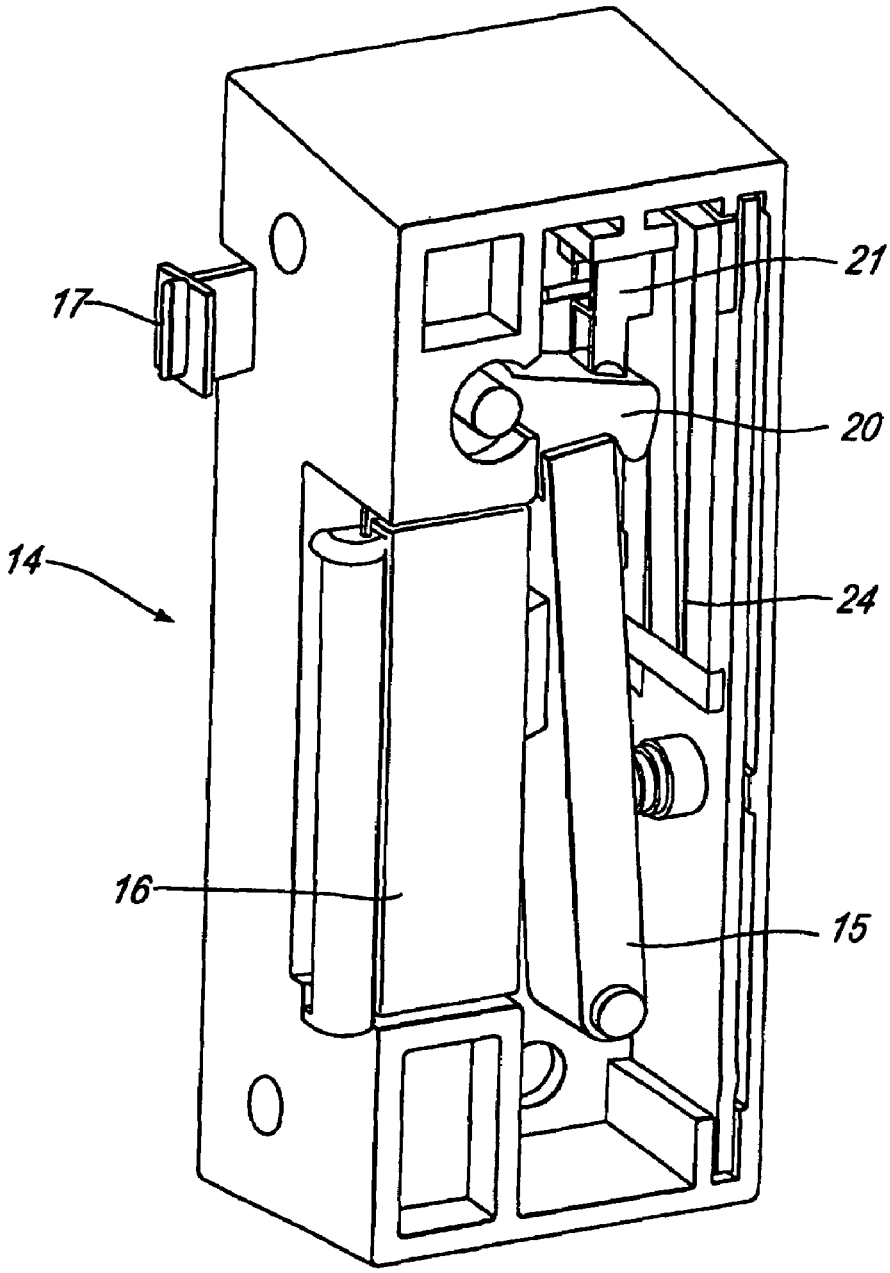
FIG. 5 shows the overall assembly of the latching mechanism according to the second embodiment of the present invention.

FIG. 5 shows the overall assembly of the latching mechanism. An external cam 17 is moveable to set the latching mechanism to a normally open or normally closed position by causing movement of the index member 21. The default position of the member 21 may be set by the user of the mechanism.

The invention claimed is:

1. A latching mechanism arranged to receive a locking member of a lock, the mechanism comprising means for blocking movement of the locking member in a first direction and permitting movement of the locking member in the first direction by movement in a direction transverse to the first direction and a pawl engageable with the blocking means, the mechanism further comprising an electrical actuator which is in contact with an index member to electrically control the pawl, the index member and the pawl member each being provided with a plurality of protrusions, wherein the index member is manually moveable between a first default position whereby the protrusions of the pawl are aligned with the protrusions of the index member to enable the latching mechanism to be in a normally locked position and a second default position whereby the protrusions of the pawl are misaligned with the protrusions of the index member, to enable the latching mechanism to be in a normally unlocked position.

2. A latching mechanism according to claim 1 wherein the actuator is a piezo electric actuator.

3. A latching mechanism according to claim 1, wherein movement of the actuator causes alignment between protrusions of the pawl and protrusions of the index member, to enable the latching mechanism to be in a locked condition.

4. A latching mechanism according to claim 1, wherein movement of the actuator causes misalignment of the protrusions of the pawl and the protrusions of the index member, to enable the latching mechanism to be in an unlocked condition.

5. A latching mechanism according to claim 2, wherein movement of the actuator causes alignment between protrusions of the pawl and protrusions of the index member, to enable the latching mechanism to be in a locked condition.

6. A latching mechanism according to claim 2, wherein movement of the actuator causes misalignment of the protrusions of the pawl and the protrusions of the index member, to enable the latching mechanism to be in an unlocked condition.

* * * * *